United States Patent [19]

Chatwin et al.

[11] 4,251,035

[45] Feb. 17, 1981

[54] POSITION INDICATOR

[76] Inventors: Ian M. Chatwin, 107 Thomas St.; Roger H. S. Riordan, 15 Regent St., both of East Brighton, Victoria, Australia

[21] Appl. No.: 36,513

[22] Filed: May 7, 1979

[51] Int. Cl.[3] ..... B02C 25/00

[52] U.S. Cl. ..... 241/37; 241/207; 324/61 R

[58] Field of Search ..... 324/61 R, 61 P; 241/37, 241/207

[56] References Cited

U.S. PATENT DOCUMENTS

| | | | |
|---|---|---|---|
| 3,133,706 | 5/1964 | Mertz | 241/37 X |
| 3,566,222 | 2/1971 | Wolfendale | 324/61 R X |
| 3,928,796 | 12/1975 | Kaiser | 324/61 R |

*Primary Examiner*—Mark Rosenbaum
*Attorney, Agent, or Firm*—Berman, Aisenberg & Platt

[57] ABSTRACT

A position indicator for monitoring movement of one part of an assembly relative to another—e.g., for monitoring the relative positions of the movable and fixed jaws of a gyratory crusher. The position indicator has a body which is fixed to a probe suitable support and a variable capacitor which responds to movement of the member to be monitored to adopt a capacitance value which is characteristic of each position of that member relative to the support. The capacitor is connected into an electrical circuit operative to generate a signal which varies according to the capacitance value and therefore provides an indication of the position of the member being monitored. The probe body includes at least two telescopic tubes arranged so that the body extends and contracts in accordance with movement of the member being monitored and conductive parts of the variable capacitor are connected to the tubes, so that their relative positions change with extension and contraction of the probe body. Hydraulic fluid is provided between the conductive parts to act as a dielectric. Thus, the capacitance value varies according to the relative positions of the two tubes.

16 Claims, 7 Drawing Figures

POSITION INDICATOR

BACKGROUND OF THE INVENTION

This invention relates to a device for indicating the position of one part of an assembly relative to another part. One application of that kind of device is in relation to adjustment of the mantle of a gyratory crusher, and it will be convenient to hereinafter describe the invention in relation to that particular example.

The gyratory crusher mantle is usually supported in a selected position relative to the concave of the crusher, and that position is adjusted from time to time to achieve a desired "closed side setting," which is the term used to identify the minimum clearance space between the concave and the mantle. That clearance will be selected to suit end user requirements—i.e., the degree of fineness of the crushed product—and occasional adjustment may be necessary to compensate for wear. Because of the nature of the crusher construction, it is not a simple matter to accurately set and maintain the mantle position, and position indicator systems utilized to date have not been satisfactory.

In one prior indicator system, the mantle position has been determined by reference to the level of oil in the feed reservoir for the hydraulic cylinder which supports the mantle in its position relative to the inner cone. The accuracy of that system is adversely affected by small amounts of air in the oil, the inevitable loss of oil under pressure, and varying temperatures of the oil. Another proposal involves the use of an electrical displacement transducer connected to the lower end of the mantle support cylinder, but that has the disadvantage that it is not readily adaptable to existing equipment and is therefore used mainly as an original component on new equipment. The difficulty of attaching the transducer to existing equipment arises, at least in part, from the fact that the transducer assembly must be substituted for the lower end of the mantle support cylinder and projects substantially below that end of the cylinder. There is not always sufficient space to accept that projection of the assembly.

OBJECTS AND SUMMARY OF THE PRESENT INVENTION

It is a principal object of the present invention to provide a position indicator which is of relatively simple and effective construction, and which can be used in a confined space. In particular, such an indicator is readily usable with a gyratory crusher, either as an original component or as an attachment to existing equipment. It is a further object of the invention to provide a gyratory crusher having improved monitoring of the mantle position.

A position indicator according to the invention is of the electrical transducer type, and involves use of a capacitive probe which is adapted to respond to movement of the member to be monitored, so that the capacitance value of the probe varies with that movement. Thus, changes in capacitance value can be related to a preselected datum so as to achieve a decipherable indication of the member position. In one particular form of the invention which is hereinafter described in detail, the indicator device is telescopic so as to expand and contract as required in response to movement of the member to be monitored, and mechanical components of that device which experience a change in relative position as a result of that expansion or contraction also serve as part of the electrical system which generates the position indicator signal. There is a substantial economy of construction in that particular form.

If a telescopic probe indicator as referred to above is to be applied to a gyratory crusher, it is preferable to arrange the device for insertion into the lower end of the mantle support cylinder. For that purpose, it will be necessary to provide an appropriate opening in the lower end of the support cylinder, and it may be also necessary to form a cavity in the adjacent end of the piston of that cylinder to receive at least part of the telescopic body of the probe. Such an arrangement will be hereinafter described as an example application of the invention.

BRIEF DESCRIPTION OF THE DRAWINGS

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

In the drawings

DETAILED DESCRIPTION OF THE INVENTION

Figures 1, 6, 7:
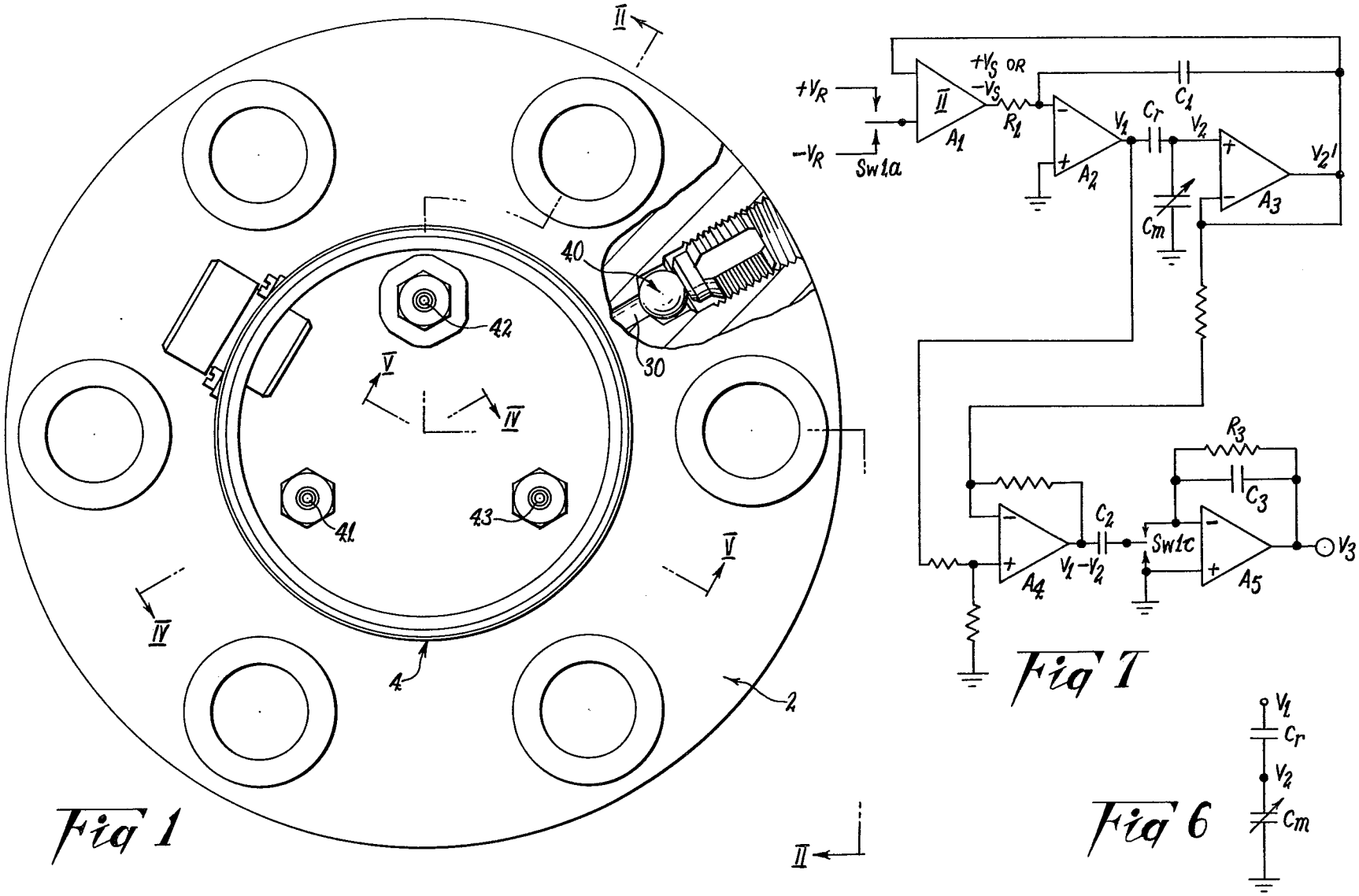
FIG. 1 is an end elevation of a position indicator according to one embodiment of the invention.
FIG. 6 is a diagram representing the basic components of the indicator circuit.
FIG. 7 is an example form of circuit for the indicator shown in diagrammatic form.
Figures 2, 4, 5:
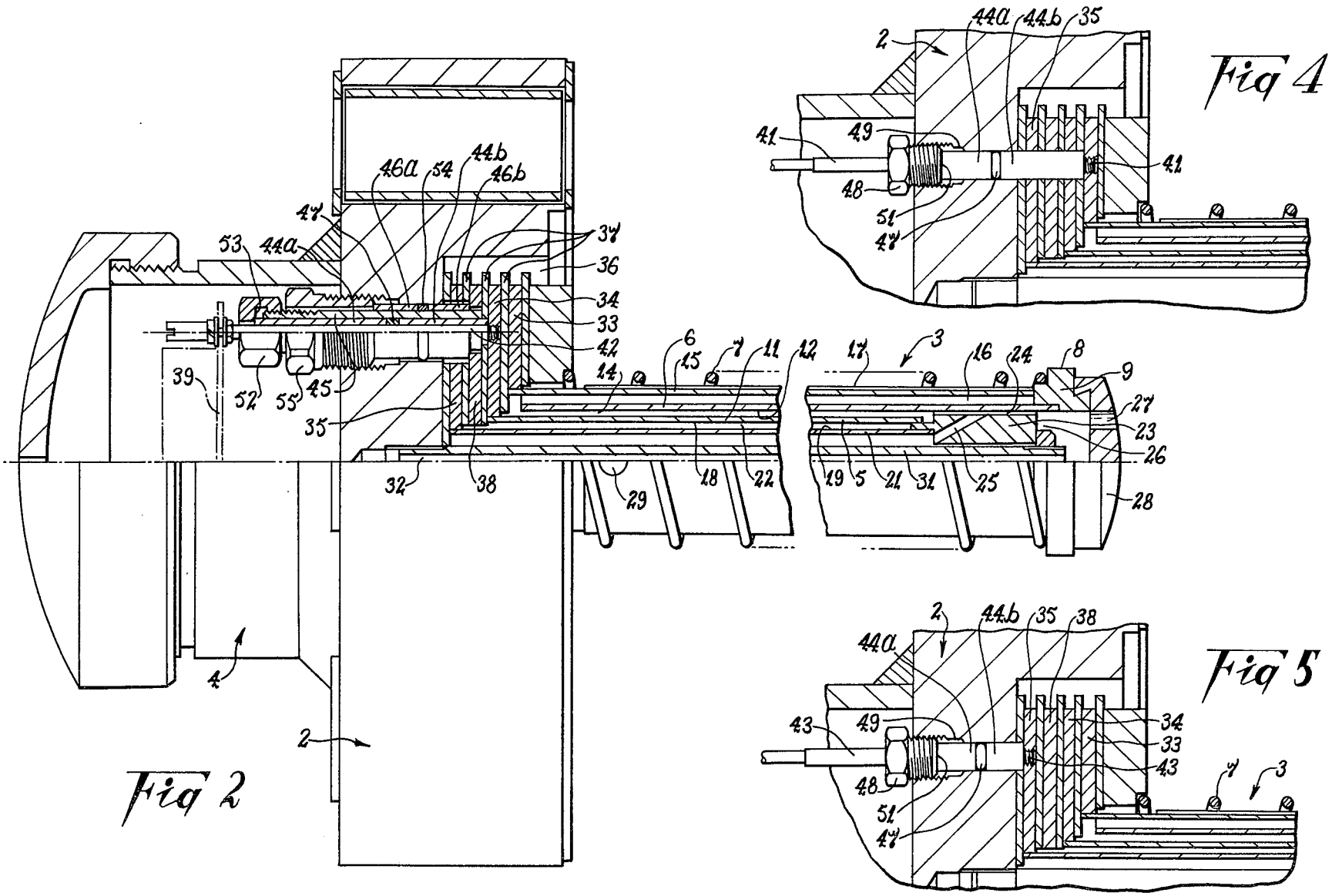
FIG. 2 is a longitudinal cross-sectional view taken along line II—II of FIG. 1.
FIG. 4 is a cross-sectional view taken along line IV—IV of FIG. 1.
FIG. 5 is a cross-sectional view taken along line V—V of FIG. 1.

FIGS. 1 and 2 show an example indicator device for use in a gyratory crusher which includes a mounting section 2 which is attachable to an end of the crusher support cylinder, a telescopic probe body 3 projecting from one side of that mounting section 2, and a hollow cap section 4 attached to the opposite side of the mounting section 2. The cap section 4 preferably contains appropriate circuitry for the probe, but in an alternative arrangement that circuitry can be located remote from the indicator device. Conductor wires (not shown) can protrude through a wall of the cap section 4 to connect the circuitry to an appropriate read-out instrument or apparatus (not shown).

In the preferred form shown, the probe body 3 is a telescopic cylinder, but it is conceivable that it may be of another configuration such as overlapping flat plates or bars. The cylindrical telescopic body includes a fixed tube 5 which is secured at one end to the mounting section 2, and a sleeve 6 located over the fixed tube 5 and adapted to move axially relative thereto. Biasing means urges the sleeve 6 axially outwards away from the mounting section 2, and that means may comprise a helical compression spring 7 surrounding the sleeve 6 and acting between the mounting section 2 and an annular flange 8 secured to the outer end of the sleeve 6. That flange may form part of an outer end ring 9 of the probe body as hereinafter described.

Figure 3:
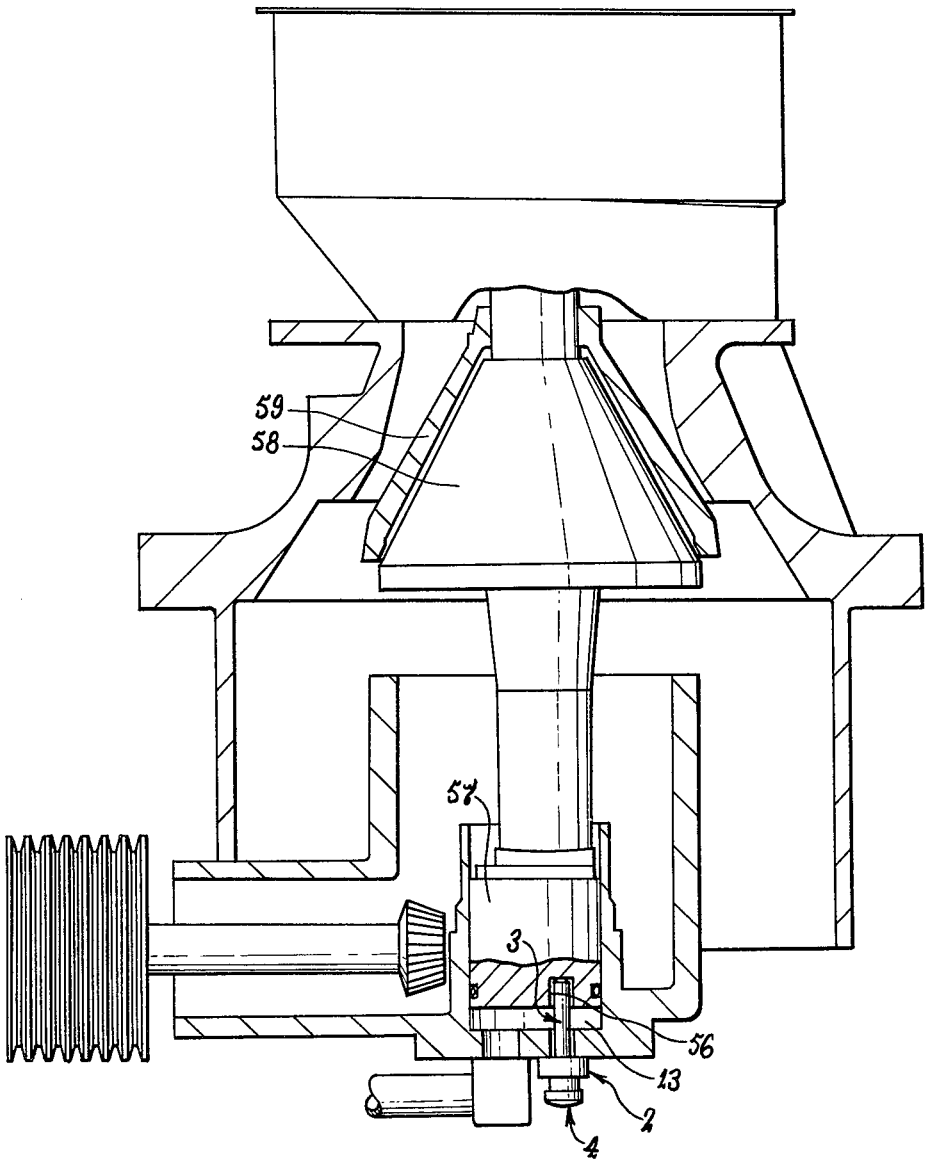
FIG. 3 is a semi-diagrammatic view showing one possible application of the indicator of FIGS. 1 and 2.

The tube 5 and sleeve 6 co-operate to form a variable capacitor, and for that purpose each is formed of an appropriate conductive material such as brass, and a suitable dielectric is located between their adjacent cylindrical surfaces 11 and 12. When applied to a gyratory crusher as described, that dielectric may be formed by the hydraulic fluid used within the support cylinder 13 (see FIG. 3), and access to the space 14 between the cylindrical surfaces 11 and 12 may be achieved in any suitable manner. It is desirable to provide guide means whereby the sleeve 6 is held in substantial coaxial relationship with the capacitor tube 5 so that the clearance space 14 between them is maintained. In the construction shown, such a guide is formed by a cover tube 15 secured to the mounting section 2 and extending substantially the full length of the probe body 3, when that body is in its fully contracted condition as shown in FIG. 2. Sliding engagement between the sleeve 6 and the inner surface of the cover tube 15 is preferably achieved through an electrically non-conductive layer 16 which is formed about the outer cylindrical surface of the electrically conductive part of the sleeve 6. Preferably, that layer is made of a material having a low-coefficient of thermal expansion together with good electrically insulating properties, and examples of suitable materials are Ferrobestos (Reg. T.M.) and epoxy glass-fibre.

With the described construction, it is desirable to have the biasing spring 7 located about the cover tube 15 as shown. Furthermore, the cover tube 15 may serve as an electrical guard against fringe effects, in which event it may comprise an electrically conductive body of brass or other suitable material having an insulating layer 17 on its outer surface. That insulation can be formed by a plastic coating heat shrunk or otherwise secured to the outer surface of the body 15.

A fixed reference capacitor is also provided in the device, and that may be formed by the inner surface 18 of the fixed tube 5 and the outer surface 19 of a further tube 21 located within and spaced from the fixed tube 5. The inner tube 21 may be of brass or other suitable conductive material, and is fixed to the mounting section 2 so as to extend therefrom coaxial with the outer fixed tube 5. It may be convenient to arrange the tubes 5 and 21 so that their capacitance value (which is fixed) is approximately equal to that of the variable capacitor when the probe body 3 is fully contracted. Once again, the hydraulic fluid of the cylinder 13 may be used as the dielectric within the space 22 between surfaces 18 and 19.

The outer ends of the capacitor sleeve 6 and tubes 5 and 21 can be maintained in suitable spaced relationship by an end plug 23 having appropriate passages 24 and 25 therein to permit flow of hydraulic fluid between the dielectric spaces 14 and 22 and one or more access openings for that fluid provided in the probe body 3.

In the particular construction shown, hydraulic fluid gains access to the interior of the probe body 3 through the central opening 26 of the outer end ring 9, opening 27 in an end cap 28 of the probe body 3, and a further opening 29 in the cover tube 15 at a position adjacent to the mounting section 2. The facility for that hydraulic fluid to circulate freely within the capacitor tube and sleeve assembly of the probe allows both the fixed and variable capacitors to be equally influenced by temperature gradients in the fluid.

If desired, the indicator device may be arranged to assist in bleeding the hydraulic system of which the support cylinder 13 forms part. That may be achieved as shown, by providing a fluid bleed pipe 31 centrally of the capacitor tube assembly and having its outer open end in communication with the end openings 27 and 29. The inner end 32 (FIG. 2) of the bleed pipe 31 communicates with a bleed passage 30 provided in the mounting section 2 and which is controlled by an appropriate valve 40 accessible from the exterior of the support cylinder 13.

The probe tubes 5 and 21 and sleeve 6 can be connected into a suitable electric circuit through any appropriate means. In the particular construction shown however, that is achieved through a series of conductor discs 33, 34 and 35 arranged in a cavity 36 of the mounting section 2 so as to be substantially coaxial with the probe body 3. Each disc 33, 34 and 35 may be formed of brass or other suitable material, and an insulating spacer 37 is provided between each two adjacent discs. A respective one of the discs 33, 34 and 35 is in electrically conductive engagement with an inner end portion of each of the three tubes described—i.e., the discs 35 and 34 are connected to the inner and outer capacitor tubes 21 and 5 respectively, and the disc 33 is connected to the cover tube 15. A fourth disc 38 is preferably disposed between the two discs 35 and 34 connected to the inner and outer capacitor tubes 21 and 5 so as to serve as an electrical guard.

An appropriate circuit may be provided within the cap section 4 by way of a printed circuit board 39, and the four conductor discs 33, 34, 35 and 38 are connected into that circuit. In the example shown, the three tube discs 33, 34 and 35 are each connected into the circuit by a respective conductor rod 41, 42 and 43 extending substantially in the axial direction of the probe body 3 but arranged eccentric thereto (see FIG. 1). A suitable insulation is provided around each rod 41, 42, 43 where it passes through a conductor disc other than that to which it is connected, and in the arrangement shown that is achieved through a sleeve 44 of electrically insulating material. The circuit connection for the electrical guard disc 38 may include a conductive tube 45 provided around the conductor rod 42 as shown in FIG. 2, but insulated therefrom by the associated sleeve 44. In that special case, a further insulating sleeve 46 is provided around an appropriate part of the length of tube 45.

As the hydraulic pressure within the mantle support cylinder 13 may be quite high (e.g. 3000 p.s.i.) and the fluid in the cylinder 13 has access to the cavity 36 containing the conductor discs 33, 34, 35 and 38, it is desirable to arrange a substantially fluid tight seal about each of the conductor rods 41, 42 and 43. Each rod 41, 42 and 43 may be secured to its respective disc 33, 34 and 35 in any suitable fashion, such as by a threaded connection and solder to resist separation of the threaded parts. In one particular fluid seal arrangement as shown in FIGS. 2, 4 and 5, each insulation sleeve is divided transversely to form two separate parts **44*a* and 44*b*, each of which is a neat fit within a cylindrical passage formed in the probe body 2, or in the tube 45 in the special case of rod 42 (FIG. 2). A resilient O-ring 47 or other annular sealing element is located around the rod 41, 42, 43 and between adjacent ends of the insulating sleeve parts 44*a* and 44*b*, so that compression of the O-ring 47 between those sleeve parts causes it to firmly engage both the associated rod and the surrounding passage surface. In the case of rods 41 and 43, such compression may be obtained, as shown, through a gland screw 48 rotatably mounted on the rod and having an external thread which cooperates with an internal thread of a counterbored section 49 of the aforementioned cylindrical passage. An end surface 51 of the gland screw 48 is arranged to engage an end of one of the sleeve part 44a so that inwards adjustment of the screw position causes compression of the O-ring 47. Quite obviously, other sealing arrangements could be used, and the particular arrangement described could be varied so that only one insulating sleeve is used and the O-ring is compressed between an end of that sleeve and an opposing surface of the gland screw 48** or probe body.

In the special case of the conductor rod 42, the inner surface of the guard tube 45 functions as the outer surface against which the O-ring 47 is pressed. Also, compression of that O-ring 47 may be achieved by a gland nut 52 threadably mounted on the guard tube 45 and having an internal shoulder 53 which abuts against and end of one of the sleeve part 44a. A similar type of seal may be provided around the guard tube 45, as shown in FIG. 2, and the outer surface of that tube should be insulated as previously discussed. Thus, two separate sleeve parts 46a and 46b with an intervening O-ring 54, are located about the guard tube 45, and the O-ring 54 is compressed by way of a gland screw 55 arranged as described above in relation to rods 41 and 43.

It is further preferred that the end cap 28 is made of Delrin (Reg. T.M.) or other suitable material, and extends over the outer end of the probe body 3 so as to form an abutting surface, which, in use engages the base of the piston cavity 56 (see FIG. 3) within which the probe 3 is located. Thus, as the piston 57 moves within the support cylinder 13, the capacitor sleeve 6 follows and thereby extends or contracts the variable capacitor. The consequent change in the capacitance value can be detected from the aforementioned probe circuit. As will be seen from FIG. 3, in that example use of the invention, the piston 57 is directly connected to the crusher mantle 58 so that movement of the piston 57 causes corresponding movement of the mantle 58 relative to the concave 59. Consequently, if the aforementioned capacitance value is related to an appropriate datum, a determination of the mantle position is possible.

The electrical response of the device may be readily understood by reference to FIGS. 6 and 7 of the attached drawings. FIG. 6 illustrates, diagrammatically, the circuit formed by the fixed and variable capacitors described, and FIG. 7 illustrates, diagrammatically, an example amplifier circuit as may be adapted for use with those capacitors—i.e., the FIG. 7 circuit may be included in the cap section 4 of the device described.

Referring to FIG. 6, the capacitive probe consists of a fixed reference capacitor Cr (tubes 5 and 21) in series with a variable measuring capacitor Cm (tube 5 and sleeve 6), the end of which is grounded. It is desirable that an amplifier be arranged to produce an output voltage proportional only to the ratio between the two capacitors. As Cm varies linearly with movement of piston 57, the piston position can be designated, in terms of height h, as:

$$h = k\frac{Cm}{Cr} \qquad (1)$$

where k is a calibration constant.

If an alternating voltage V1 is applied to the reference capacitor (Cr), the voltage V2 across Cm can be measured, and the following relationship applies:

$$CmV2 = Cr(V1 - V2)$$

thus $$\frac{Cm}{Cr} = \frac{V1 - V2}{V2}$$

and consequently, from (1), $$h = \frac{k(V1 - V2)}{V2} \qquad (2)$$

Thus if V2 is held constant the piston height h is proportional to V1−V2.

In the example amplifier circuit of FIG. 7, amplifier A1 is a bistable switch, with output voltage always +Vs or −Vs. An inverting amplifier A2, the measuring probe, and voltage follower A3, together form an integrator and the output voltage V2', which is almost equal to voltage V2 across Cm, is constrained to rise or fall at a constant rate:

$$\frac{dV2'}{dt} = \frac{V2}{C1R1} \qquad (3)$$

If Vs is positive V2' will fall until it reaches the lower threshold −Vr or A1, the output of which will then switch to −Vs and so V2 will rise linearly until it reaches the upper threshold +V2, whence the cycle will repeat. Thus V2', and therefore V2, is a linear sawtooth with constant frequency and amplitude. V1 must therefore also be a linear sawtooth but its amplitude will vary as Cm varies.

The sawtooth output voltage of A4 is equal to V1−V2' and is applied to capacitor C2 which is alternately connected to ground and to the input of integrator A5, by way of switch Sw1c. Since C2 is grounded while V1−V2' is rising and connected to A5 while it is falling, the current into the integrator and therefore the output voltage V3, are proportional to the magnitude of V1−V2', which is of course characteristic of the movement of the piston 57.

It will be appreciated from the foregoing that an indicator device as described can be conveniently attached to a gyratory crusher (or other apparatus), and is operative to provide a voltage signal which is readily adapted to give an accurate indication of mantle position. In this regard, the mantle position is directly related to the position of the piston in the supporting cylinder and the probe device cooperates with that piston so as to accurately monitor its movement. As the device can be contained at least in part, within a cavity of the piston, it requires limited space beneath the cylinder and does not prevent the piston from reaching its lowermost position in the cylinder.

A gyratory crusher including an indicator device as described is readily adapted for remote and/or automatic control of the mantle position. In automatic control the indicator device can be connected into a feedback system such that appropriate corrective adjustment of the mantle position is automatically effected when a shift from a preselected position is detected.

Finally, it is to be understood that various alterations, modifications and/or additions may be introduced into the constructions and arrangements of parts previously described without departing from the spirit or ambit of the invention as defined by the appended claims.

Having now described our invention, what we claim as new and desire to secure by Letters Patent is:

1. In a gyratory crusher of the kind having a mantle mounted for adjustment relative to a concave and a hydraulic piston-cylinder assembly for controlling that adjustment, the piston of said assembly being connected to said mantle for movement therewith, the improvement comprising: a position indicator having a probe body which is secured to a wall of the cylinder of said assembly to project into the interior of said cylinder, a variable capacitor connected to said body and being responsive to movement of said piston to adopt a capacitance value which is characteristic of each position of said piston relative to said cylinder, a reference capacitor having a fixed capacitance value, circuit means operable to compare the respective capacitance values of said variable and fixed capacitors and to generate a signal characteristic of the ratio of the two said capacitance values, said signal varying with changes in said ratio according to changes in the capacitance value of said variable capacitor and thereby providing an indication of the position of said mantle relative to a preselected datum.

2. A gyratory crusher according to claim 1, wherein said probe body has at least one opening to permit access to hydraulic fluid from said cylinder, and said probe body is arranged so that the hydraulic fluid received therein acts as a dielectric for said capacitors.

3. A gyratory crusher according to claim 2, wherein a fluid bleed passage is provided through said position indicator and is adapted to be selectively opened to permit bleeding of the hydraulic fluid in said probe body.

4. A gyratory crusher according to claim 1, wherein the reference and variable capacitors have a dielectric which is of the same material for both capacitors.

5. A gyratory crusher according to claim 4, wherein said dielectric is fluid.

6. A position indicator comprising: a probe body which is securable to a support; a variable capacitor connected to said body and being responsive to movement of a member to be monitored, said variable capacitor adapted to provide a capacitance value which is characteristic of each position of said member relative to said support, a reference capacitor having a fixed capacitance value, circuit means operable to compare the respective capacitance values of said variable and fixed capacitors and to generate a signal characteristic of the ratio of the two said capacitance values, said signal varying with changes in said ratio according to changes in the capacitance value of said variable capacitor and thereby providing an indication of the position of said member relative to a preselected datum.

7. A position indicator according to claim 6, further comprising a mounting section through which said probe body is securable to a support, said probe body including two parts one of which is fixed relative to said mounting section and the other is movable relative thereto, thereby causing variation in the overall size of said probe body, each said body part having attached thereto a respective conductive part of said variable capacitor, and a dielectric is provided between said conductive parts.

8. A position indicator according to claim 7, wherein the two said body parts are in the form of a tube and a sleeve respectively, said tube and sleeve being substantially concentric and telescopically arranged to permit expansion and contraction of said probe body, and said conductive parts comprise respective adjacent surfaces of said tube and sleeve.

9. A position indicator according to claim 8, wherein said sleeve is located about said tube and is said movable body part, said sleeve is secured to an end part of said probe body located remote from said mounting section, and biasing means acts between said end part and said mounting section to urge said sleeve axially away from said mounting section.

10. A position indicator according to claim 9, wherein said sleeve is guided in concentric relationship to the tube by means of a cover tube located around said sleeve and secured to said mounting section, at least one of the opposed surfaces of said cover tube and said sleeve comprises an electrically non-conductive material which engages the other one of the opposed surfaces in sliding relationship.

11. A position indicator according to claim 10, wherein said cover tube includes a cylindrical body of electrically conductive material, and a layer of electrical insulating material is provided on the cylindrical outer surface of that body.

12. A position indicator according to claim 8, wherein said reference capacitor is formed by said fixed tube and a further tube located concentrically within said fixed tube and secured to said mounting section, and said dielectric is provided between the adjacent surfaces of said further and fixed tubes.

13. A position indicator according to claim 7, wherein said circuit means includes a printed circuit board provided in said mounting section.

14. A position indicator according to claim 6 wherein said reference and variable capacitors have a dielectric which is of the same material for both capacitors.

15. A position indicator according to claim 14 wherein said dielectric material is a fluid.

16. A position indicator according to claim 15 wherein said dielectric fluid is a hydraulic fluid.

* * * * *